United States Patent [19]

Daniels

[11] Patent Number: 4,570,778

[45] Date of Patent: Feb. 18, 1986

[54] VEHICLE SECURITY APPARATUS

[76] Inventor: Edward N. Daniels, 1961 Delaware St., Gary, Ind.

[21] Appl. No.: 524,906

[22] Filed: Aug. 22, 1983

[51] Int. Cl.[4] ..... G07F 5/10; G07F 17/10

[52] U.S. Cl. ..... 194/239; 70/237; 194/900

[58] Field of Search ..... 194/1 R, 9 R, 9 T, 40, 194/49, 64, DIG. 21, DIG. 22, DIG. 23; 70/237; 211/9, 23, 24; 180/287, 289

[56] References Cited

U.S. PATENT DOCUMENTS

| | | | |
|---|---|---|---|
| 1,351,297 | 8/1920 | McCracken | 70/237 |
| 1,726,724 | 9/1929 | Warren | 70/225 X |
| 1,924,533 | 8/1933 | Babson | 194/49 X |
| 2,153,480 | 4/1939 | Pierce | 194/DIG. 22 |
| 3,900,092 | 8/1975 | Page et al. | 194/9 T |
| 3,986,591 | 10/1976 | Patton | 194/1 R |
| 4,312,452 | 1/1982 | Waier | 211/23 |

*Primary Examiner*—F. J. Bartuska

*Attorney, Agent, or Firm*—McDougall, Hersh & Scott

[57] ABSTRACT

An apparatus for securing a vehicle parked in a selected location to prevent its theft. The apparatus includes a stanchion supporting a pivotally mounted bumper engaging arm. The arm includes a portion projecting outwardly of the stanchion toward the vehicle when the vehicle is to be locked in place. In this position of the arm, an extension on the end of the arm extends upwardly to fit behind the vehicle bumper for thereby preventing movement of the vehicle away from the stanchion. A drive is provided for driving the arm between an inoperative position and an operative position for securing the vehicle. A coin operated arrangement is employed for energizing the drive after the vehicle is moved into position adjacent the stanchion.

3 Claims, 9 Drawing Figures

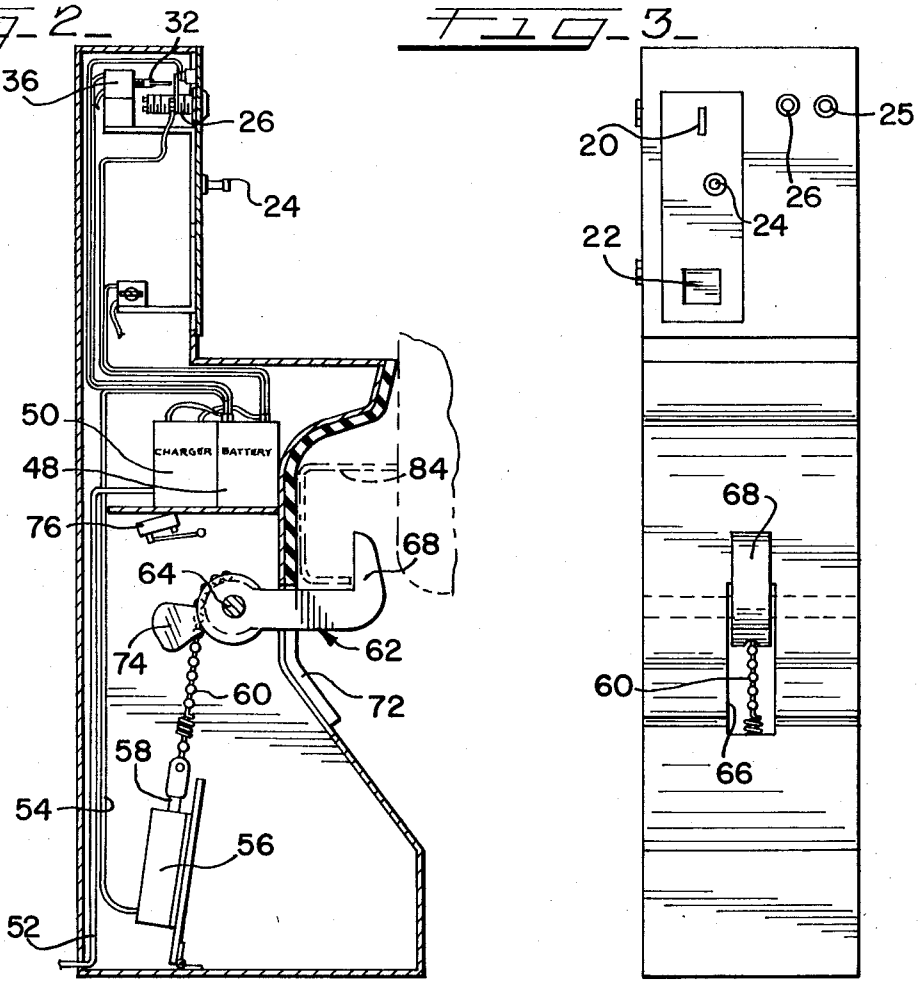
FIG. 3
FIG. 2
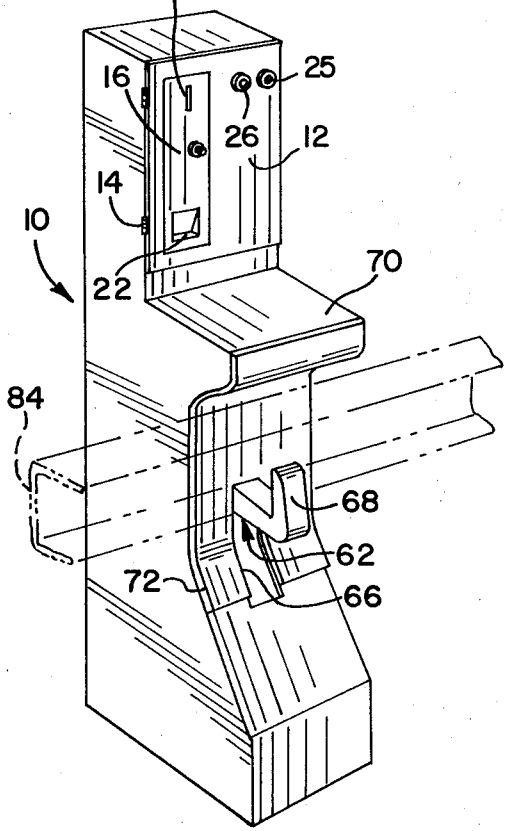
FIG. 1

VEHICLE SECURITY APPARATUS

BACKGROUND OF THE INVENTION

The need for means to prevent theft of automobiles is well-known. Numerous techniques have been developed for discouraging theft including alarms which will operate when a vehicle has been tampered with. In addition, various mechanisms have been developed for disabling an automobile after it has been parked, for example, locks designed to prevent use of the steering wheel. Other systems have involved disabling of necessary operating components such as starter mechanisms.

Thieves have invariably found techniques for bypassing previously developed devices. Furthermore, devices which must be purchased by the owner of a vehicle and carried with the vehicle are often relatively expensive and, therefore, owners do not universally use such devices.

Operators of shopping centers, parking lots, and the like have a particular concern about theft of automobiles. Where the thievery is prevalent, persons will be discouraged from using the facility, and business will be affected. Accordingly, there is a need for mechanisms which can reliably prevent thefts, which do not represent any expense for the owner of a vehicle, and which will be useful in connection with large parking areas such as at shopping centers.

Attempts have been made to develop mechanisms which could be located in a parking stall or the like and which will discourage thievery of the automobile. Such mechanisms are described in McCracken U.S. Pat. No. 1,351,297, Warren U.S. Pat. No. 1,726,724, and Waier U.S. Pat. No. 4,312,452. A consideration of these devices by applicant has revealed, however, that they are not suited for application in a shopping center or the like either because they could not be relied upon to provide adequate security or because the mechanisms do not lend themselves to efficient production and operation.

SUMMARY OF THE INVENTION

This invention concerns an apparatus which is especially designed for protecting vehicles against theft when the vehicles are located in a parking lot such as at a shopping center. The apparatus of the invention includes a stanchion which is provided for a particular parking space. The stanchion supports a bumper engaging arm which is pivotally connected to the stanchion, and which includes a first portion adapted to project outwardly toward a vehicle located in the parking space. The arm is provided with an extension which extends upwardly for fitting behind the bumper of the vehicle thereby preventing any unauthorized person from driving or towing the vehicle away from the parking space.

The stanchion provides a housing for a drive means which is connected to the arm. A coin operated mechanism is employed for energizing the drive means whereby the vehicle operator can utilize the apparatus of the invention by inserting the appropriate amount in a coin slot provided on the stanchion. The invention also contemplates the use of a key and key slot exposed on the stanchion so that the vehicle operator can lock the bumper-engaging arm in place after inserting the proper payment. The operator will keep the key in his possession until returning for his car at which time he can unlock the apparatus leaving the key in place for the next user of the parking space.

BRIEF DESCRIPTION OF THE DRAWINGS

FIG. 1 is a perspective view of the vehicle securing apparatus of the invention;

FIG. 2 is a vertical, sectional view of the apparatus with the bumper engaging arm in operative position;

FIG. 3 is a front elevational view of the apparatus;

DETAILED DESCRIPTION OF THE INVENTION

Figure 7:
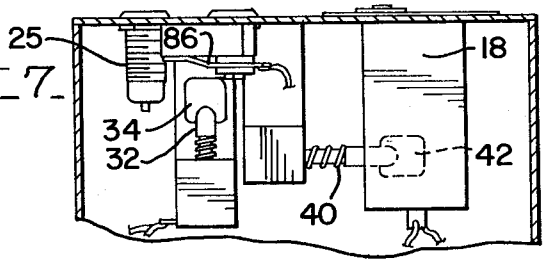
FIG. 7 is a fragmentary, cross-sectional view taken about the line 7—7 of FIG. 5.

The drawings illustrate a stanchion 10 which is in the form of a housing adapted to hold the various components of the apparatus. The upper portion of the stanchion includes a door 12 mounted on hinges 14. The door supports a face plate 16 of a coin receiving box 18. This face plate defines a coin slot 20, coin return opening 22, and a coin return button 24. A lock 25 of any conventional type may be used for maintaining door 12 closed.

Figure 4:
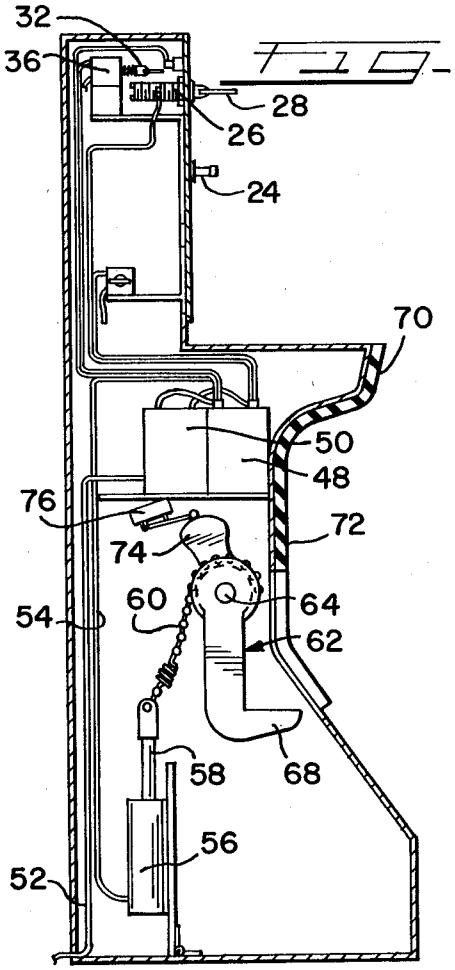
FIG. 4 is a vertical, sectional view of the apparatus with the bumper engaging arm in inoperative position.

The upper housing 12 also supports a key slot 26 for receiving a key 28 as shown in FIG. 4. Operation of the key achieves movement of arm 30 as will be explained in greater detail.

Figure 6:
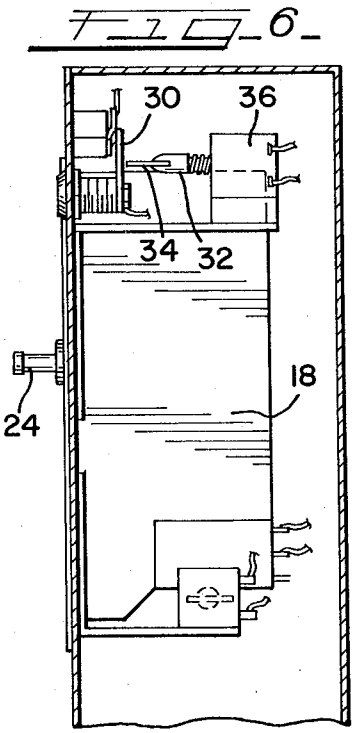
FIG. 6 is a fragmentary, cross-sectional view taken about the line 6—6 of FIG. 5.

A spring-loaded rod 32 carries a plate member 34 at its outer end. The rod 32 is associated with solenoid 36 and is shown in FIG. 6 in the pulled-in position, that is, with the solenoid energized. When the solenoid is de-energized, the plate member 34 extends outwardly into the path of arm 30 thereby preventing movement of this arm in response to operation of key 28.

Figure 5:
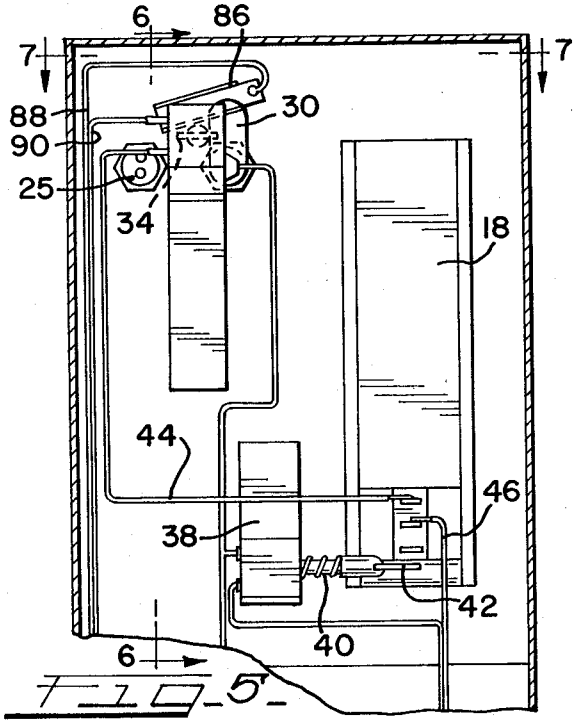
FIG. 5 is a fragmentary, horizontal, cross-sectional view of the apparatus.

The stanchion housing also holds a second solenoid 38 which controls the position of rod 40. This rod carries a plate member 42 at its outer end, and this plate member is positioned in the path of coins deposited in the apparatus. With the plate member 42 in the position shown in FIG. 5, a coin deposited in the apparatus will be prevented from falling into a coin collection receptacle (not shown). Furthermore, the presence of the coin will serve to close a circuit including wires 44 and 46 which will result in energizing of solenoid 36. This will retract rod 32 thereby freeing the arm 30 for movement in response to operation of key 28.

The wire 46 extends to battery 48 which is associated with battery charger 50. The latter is connected to wire 52, and this combination or any other conventional means may be employed for insuring the availability of power for operation of the mechanisms described.

The battery 48 is connected through wire 54 to a third solenoid 56 which operates rod 58. This rod is connected through chain 60 to a bumper engaging arm 62 which is pivotally mounted on the stanchion-supported shaft 64. As best shown in FIGS. 1 and 2, the arm 62 is adapted to project outwardly from the stanchion through an opening 66. The arm includes an extension 68 which extends forwardly when a vehicle is in position for engagement with the vehicle bumper.

The stanchion is recessed to permit location of the vehicle bumper in a position for engagement by arm 62. The recessed arrangement provides for a shoulder 70 which is located above the bumper when a vehicle is in position. This arrangement avoids the possibility of an unauthorized person attempting to lift the vehicle off the arm 62 after the vehicle has been secured in place.

The face of the stanchion in the recessed area is covered by a resilient material 72 which will prevent abrasion of the vehicle and will also minimize potential damage to the stanchion. The thickness of this material can be regulated to provide some flexibility with regard to the size of a bumper to be engaged by the arm 62. It is also contemplated that a spring-loaded arrangement or the like could be associated with the arm 62 and/or with its supporting shaft 64 to provide flexibility whereby the arm and stanchion can accommodate bumpers of various heights.

The arm 62 supports a counterweight 74 in order to minimize the work required of the solenoid 56. A normally open switch 76 is positioned in the path of this counter-weight, and the switch is adapted to be closed by the counter-weight when the arm 62 is in the inoperative position.

Figure 9:
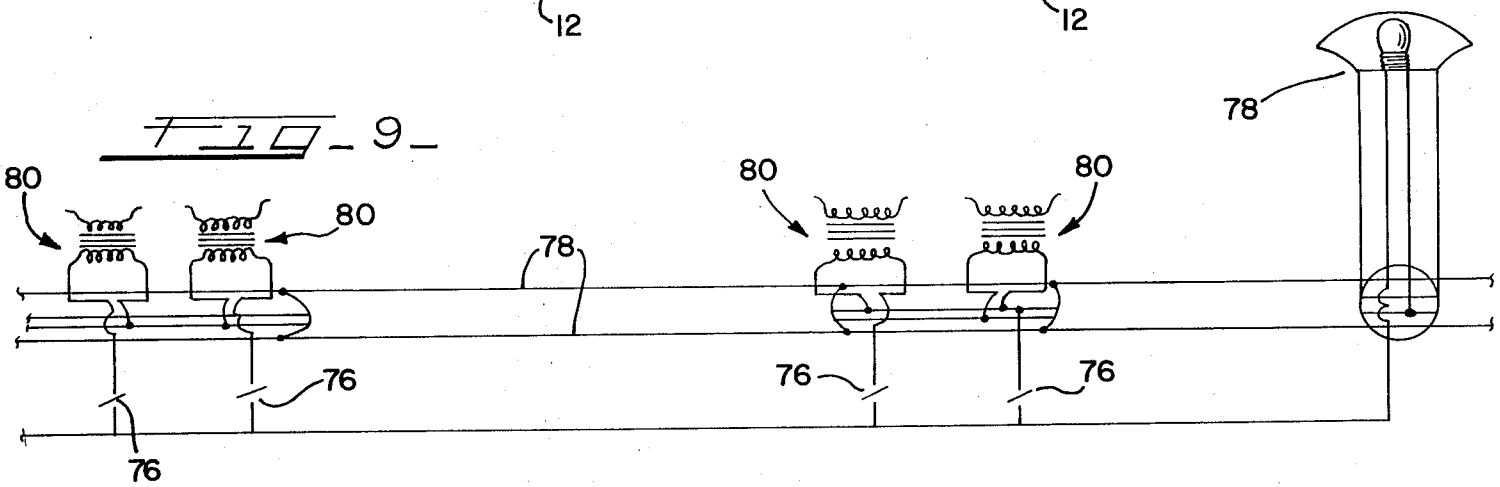

The switch 76 is included in a circuit shown diagramatically in FIG. 9. As shown, such a switch is provided for each of the structures 10 located in a line in a parking lot or the like. When each of the switches 76 is open, indicating that every parking space in a given line is occupied, the light 78 will turn off. Thus, a motorist will always know if a space is available in a given line without the need for driving down the line.

The arrangement of FIG. 9 also includes power lines 78 connected to one side of transformers 80 which may be incorporated in the structures 10. The other side of the transformers may be utilized for providing power in the system in conjunction or in lieu of battery power. In a typical arrangement, 110 volts AC may be applied to one side of the transformer to furnish 12 volts AC for operating a battery charger or rectifier or for providing power directly to solenoids used in the system.

Figure 8:
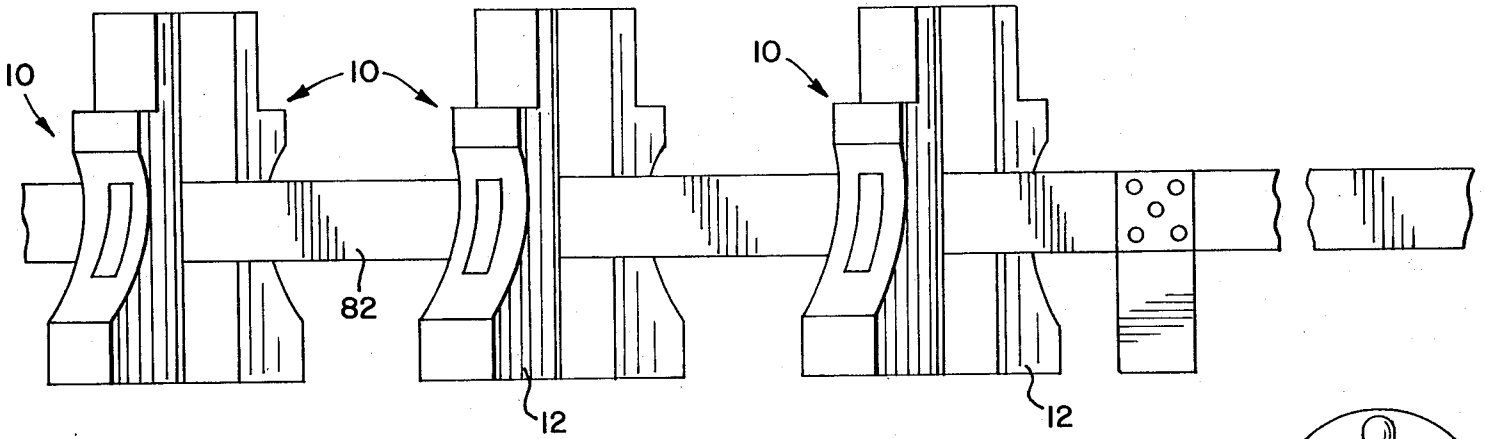
FIG. 8 is a schematic illustration of a plurality of stanchions interconnected by conductors to provide means for detecting the presence of an automobile; and, FIG. 9 is a schematic circuit diagram of a detecting means.

FIG. 8 illustrates the use of a rail 82 employed for securing the respective stanchions in an integrated assembly. The rail will provide re-enforcement to minimize damage in the system and the rail may also be used for housing power lines 78.

In the operation of a system of the type described, a driver will approach a stanchion 10 and locate his car bumper as shown by the illustration of a bumper 84 in FIGS. 1 and 2. The operator will then leave the car and insert an appropriate amount in the coin slot 20. Unless the operator pushes button 24 for returning his coins, the operator will then turn key 28.

The presence of a coin or coins of appropriate amount will close the contacts between lines 44 and 46 which energize solenoids 36. This frees the arm 30 for rotation by key 28. When rotated, the arm engages contact 86 which closes the circuit including lines 88 and 90.

Closing of this circuit accomplishes two functions. The solenoid 38 is energized pulling in the rod 40 to thereby release the coin or coins into a collection box. The solenoid 56 is also energized pivoting the arm 62 into engagement with the vehicle bumper. The vehicle operator then removes the key 28 and keeps the key until he returns to pick up his vehicle.

The cycle is reversed when the vehicle operator inserts the key and turns the arm 30 away from contact 86 thereby de-energizing solenoid 56 and solenoid 38. The vehicle can then be backed away, and the space is available for the next user.

In the foregoing description, the reference to a "bumper" is intended to refer to any portion of a vehicle which can be conveniently engaged when the vehicle is moved into a parking place. It will also be understood that the coin operated mechanism illustrated is intended only as an example with various alternative systems being available. Similarly, the circuitry discussed is considered to be conventional and not a limiting aspect of the invention. In that connection, it is contemplated that latch means could be employed for holding the bumper engaging arm in its operative position without the need for maintaining solenoids in an energized state. The solenoids or other devices could then be operated when the vehicle operator returns with the proper key.

It will be understood that various changes and modifications may be made in the above-described construction which provide the characteristics of the invention without departing from the spirit thereof particularly as defined in the following claims.

That which is claimed is:

1. An apparatus for securing a vehicle parked in a selected position to prevent the theft thereof including a stanchion, a bumper-engaging arm pivotally connected to said stanchion, said arm including a first portion adapted to project outwardly of the stanchion toward a vehicle, and an extension on said arm which extends upwardly when said arm extends outwardly, said extension being adapted to fit behind the bumper of a vehicle when the vehicle is parked adjacent the stanchion, drive means for said arm for driving the arm between an inoperative position and an operative position where the arm extends outwardly, and coin-operated means for energizing said drive means, and including a lock and key, an electrical circuit for energizing said drive means, a contact arm associated with said lock whereby turning of said key causes said contact arm to complete said circuit to energize said drive means, the presence of a coin in the apparatus permitting turning of said key, and wherein said stanchion includes a recessed portion for receiving said bumper, an opening defined by the stanchion in the portion thereof including said recessed portion, said arm extending through said opening when in the operative position, and said recessed portion defining a shoulder extending over a bumper received in the recessed portion preventing lifting of the vehicle off said arm.

2. An apparatus in accordance with claim 1 including a solenoid for driving the arm, and circuit means for energizing the solenoid, said circuit means being partially completed by the presence of a coin inserted in the apparatus.

3. An apparatus in accordance with claim 1 including switch means associated with said arm, and signal means connected to said switch means, said signal means operating to identify an open parking position when said arm is in the inoperative position.

* * * * *